US006404314B1

(12) United States Patent
Arnold et al.

(10) Patent No.: US 6,404,314 B1
(45) Date of Patent: Jun. 11, 2002

(54) ADJUSTABLE TRIP SOLENOID

(75) Inventors: David Arnold, Chester; Thomas G. O'Keeffe, Farmington; Paul Douglas Lafferty, Newington, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/515,112

(22) Filed: Feb. 29, 2000

(51) Int. Cl.[7] ..... H01F 3/00
(52) U.S. Cl. ..... 335/258; 335/273; 335/176
(58) Field of Search ..... 335/220–229, 335/298–9, 255, 251, 258, 273, 279, 257, 167–176

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanarusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |
| 4,301,342 | A | 11/1981 | Castonguay et al. |
| 4,360,852 | A | 11/1982 | Gilmore |
| 4,368,444 | A | 1/1983 | Preuss et al. |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |

(List continued on next page.)

OTHER PUBLICATIONS

International Search Report, corresponding to International Application No. PCT/US 01/0 6204, dated the Jul. 13, 2001 and a copy of each of the publications cited therein.

*Primary Examiner*—Lincoln Donovan
(74) *Attorney, Agent, or Firm*—Cantor Colburn LLP

(57) ABSTRACT

An adjustable solenoid having an enclosure containing a winding through which a current is passed. The winding defines an area and a plunger is positioned at one end of the area with a mechanical biasing mechanism for providing a biasing force to the plunger, the mechanical biasing mechanism is secured to the plunger at one end and a support at the other end. A stator having a first threaded portion engaged within a threaded opening of the enclosure causes the stator to travel between a first position and a second position as a rotational force is applied to the stator. The first position is closer to the plunger than the second position, and the stator is in a facially spaced relationship with respect to the plunger and the stator has a second threaded portion for engaging a threaded portion of the support, the second threaded portion of the stator causes the support to travel between a first position and a second position, the second position of the support provides the mechanical biasing mechanism with a greater biasing force than the first position.

29 Claims, 6 Drawing Sheets

U.S. PATENT DOCUMENTS

| | | | | |
|---|---|---|---|---|
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troehel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,463,332 | A | * | 7/1984 | Everett ..... 335/258 |
| 4,467,297 | A | | 8/1984 | Boichot-Castagne et al. |
| 4,467,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,691,182 | A | * | 9/1987 | Mrenna et al. ..... 335/176 |
| 4,694,373 | A | | 9/1987 | Demeyer |
| 4,710,845 | A | | 12/1987 | Demeyer |
| 4,711,255 | A | * | 12/1987 | Davis et al. ..... 251/129.21 |
| 4,717,985 | A | | 1/1988 | Demeyer |
| 4,733,211 | A | | 3/1988 | Castonguay et al. |
| 4,733,321 | A | | 3/1988 | Lindeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McCline |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nehon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,310,971 | A | | 5/1994 | Vial et al. |
| 5,313,180 | A | | 5/1994 | Vial et al. |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al . |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,504,284 | A | | 4/1996 | Lazareth et al. |
| 5,504,290 | A | | 4/1996 | Baginski et al. |
| 5,510,761 | A | | 4/1996 | Boder et al. |
| 5,512,720 | A | | 4/1996 | Coudert et al. |
| 5,515,018 | A | | 5/1996 | DiMarco et al. |
| 5,519,561 | A | | 5/1996 | Mrenna et al. |
| 5,534,674 | A | | 7/1996 | Steffens |
| 5,534,832 | A | | 7/1996 | Duchemin et al. |
| 5,534,835 | A | | 7/1996 | McColloch et al. |
| 5,534,840 | A | | 7/1996 | Cuingnet |

| | | | |
|---|---|---|---|
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |

FOREIGN PATENT DOCUMENTS

| | | |
|---|---|---|
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 387037 | 2/1933 |
| GB | 412606 | 7/1934 |
| GB | 2 233 155 | 1/1991 |
| WO | 92/00598 | 1/1992 |
| WO | 92/05649 | 4/1992 |
| WO | 94/00901 | 1/1994 |

* cited by examiner

HIGH CURRENT SET-UP

LOW CURRENT SET-UP

ADJUSTABLE TRIP SOLENOID

BACKGROUND OF THE INVENTION

The present invention relates to an adjustable magnetic device.

BACKGROUND

A magnetic tripping device such as a solenoid generally comprises a coil or winding of wire through which a current is passed. The solenoid is configured to manipulate an actuator when the electromagnetic force generated by the coil exceeds a predetermined value of the solenoid.

The actuator is generally biased by a mechanical force in an opposite direction of the force generated by the electromagnetic field of the coil. This force is typically provided by a spring or other mechanical means wherein a plunger of the actuator is biased with respect to a stator positioned opposite to the actuator.

In addition, an air gap is positioned in between the actuator and a stator. The air gap is also located within the coil and provides an insulating barrier to the force generated by the electromagnetic field of the coil.

Accordingly, the tripping or predetermined tolerances of a solenoid are dependent upon the mechanical biasing force and the size and positioning of the air gap.

Moreover, the required range or predetermined tolerances of a magnetic tripping device vary in accordance with user's requirements such as the circuit loading.

Most solenoids are either fixed (nonadjustable) or have a single means of adjustment for either the air gap or biasing force.

In an attempt to accommodate these varying tolerances, an adjustable trip solenoid has been developed wherein the air gap between the stator and the actuator can be varied. However, the varying of this air gap also causes the spring biasing force to vary. Moreover, these changes are opposite with respect to each other. For example, increasing the air gap will also decrease the biasing force of a spring.

Accordingly, there is a need for an adjustable solenoid wherein the air gap and mechanical biasing force can be varied so that as the air gap is decreased the mechanical biasing force is also decreased, and vice versa.

SUMMARY OF THE INVENTION

In an exemplary embodiment of the invention, an adjustable solenoid provides an adjustable air gap where the mechanical biasing force of the solenoid is either decreased or increased as the air gap is increased or decreased.

DESCRIPTION OF THE PREFERRED EMBODIMENT

Figure 1:
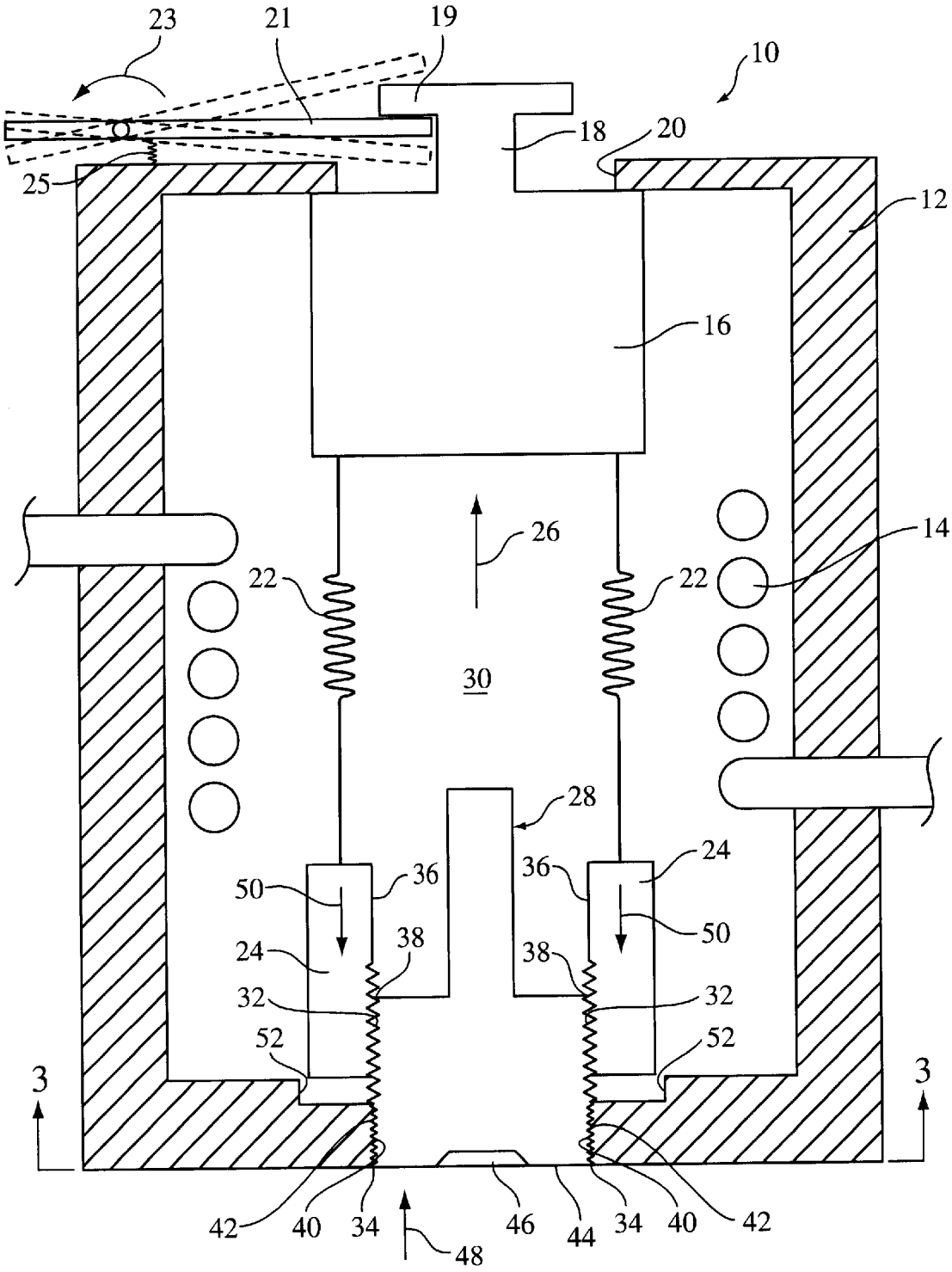
FIG. 1 is a front cross-sectional view of a solenoid constructed in accordance with the instant application.
Figure 2:
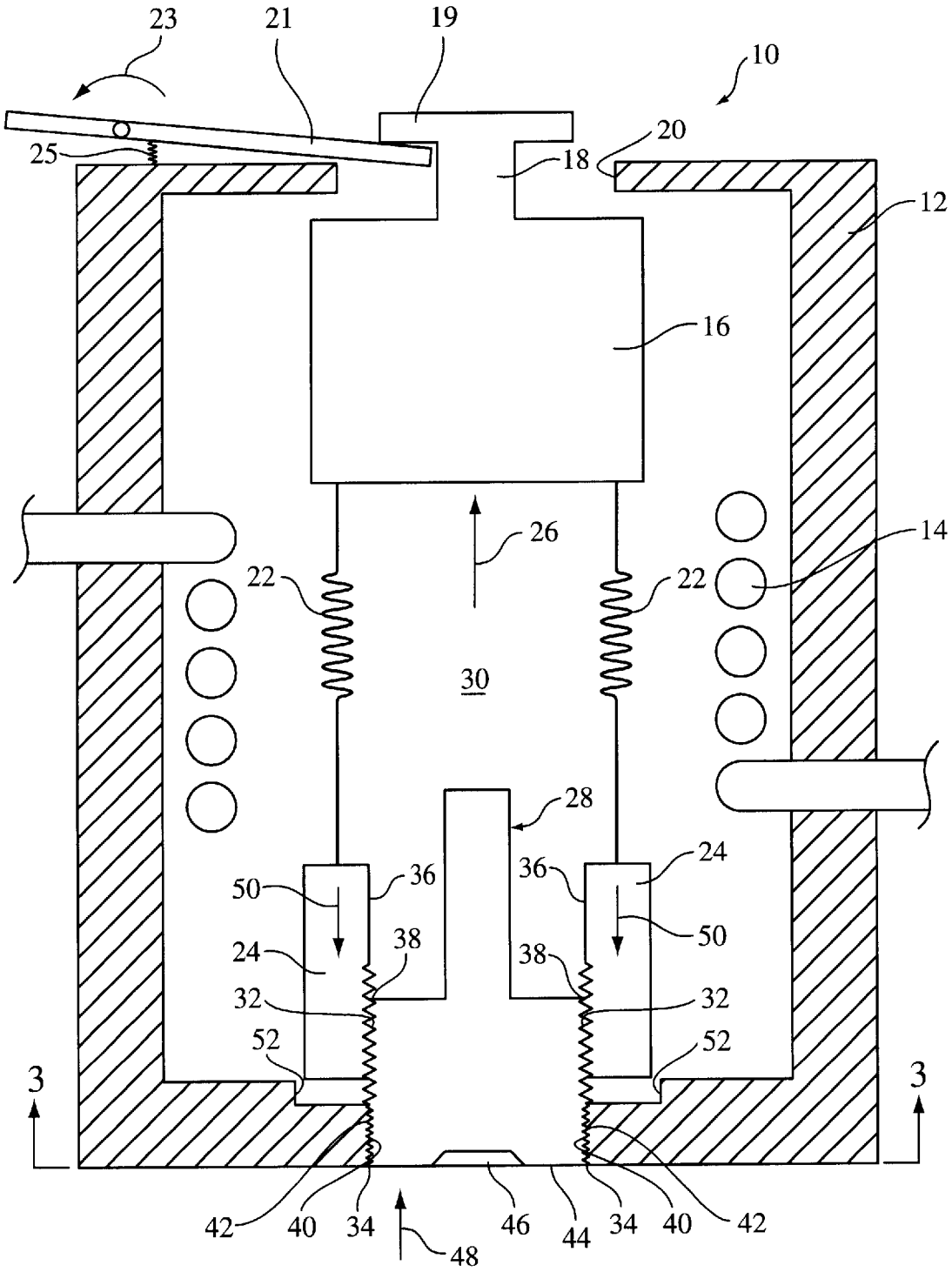
FIG. 2 is a front cross-sectional view illustrating movement of a solenoid constructed in accordance with the instant application.
Figure 7:
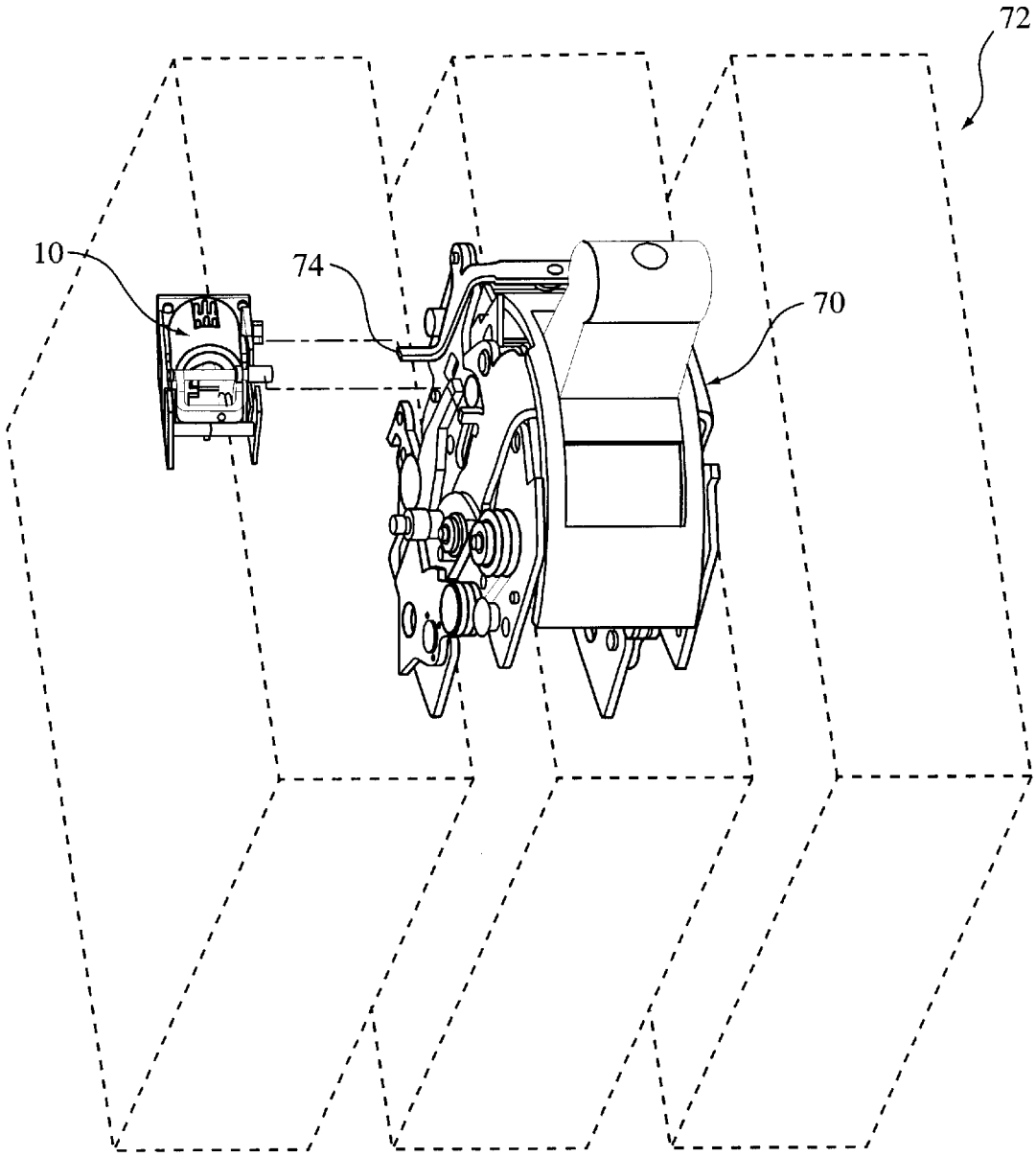
FIG. 7 is a front perspective view of circuit breaker with an adjustable trip solenoid.

Referring now to FIGS. 1 and 2, an adjustable trip solenoid 10 is illustrated. In an exemplary embodiment, solenoid 10 is coupled to a circuit interruption mechanism 70 of a circuit breaker 72 (FIG. 7) wherein the movement or actuation of solenoid 10 causes a tripping mechanism 74 to trip circuit breaker 72.

Solenoid 10 has a support structure 12 into which a coil 14 is received. Coil 14 consists of a copper wire through which a current is passed. In accordance with the direction of the current being passed through coil 14, a magnetic field is generated by solenoid 10.

A plunger 16 for movement within solenoid 10 has an actuating member 18. Actuating member 18 is configured to pass through an opening 20 in support structure 12 of solenoid 10. In addition, actuating member 18 is configured to have a planar member 19, which in conjunction with actuating member 18 provides a receiving area for a portion of an actuating arm 21. The movement of plunger and accordingly actuating member 18 causes actuating arm 21 to move from a first position to a second position (illustrated by the dashed lines in FIG. 1). See also FIG. 2.

It is intended that actuating arm 21 is to be coupled to a mechanism 74 (FIG. 6) that in accordance with the movement of actuating arm 21 from the first position to a second position, will cause an intended result of the mechanism. For example, the movement of the mechanism will cause a circuit breaker to trip. Other uses may be the activation of warning lights, indication lights, status indicators and audible alarms, etc.

In addition, actuating arm 21 is provided with a biasing force in the direction of arrow 23 that must be overcome by the movement of plunger 18. In addition, the biasing force in the direction of arrow 23 also provides stability to actuating arm 21. Moreover, the biasing force causes actuating arm 21 to return to the position illustrated in FIG. 1, once plunger 16 returns to its initial position. A spring 25 or other bias producing means causes the biasing force to be placed upon arm 21.

As an alternative, and as illustrated by the dashed lines in FIG. 1, actuating arm 21 is positioned to rest upon plunger 18 and the biasing force of spring 25 is in a direction opposite to arrow 23. In addition, and as yet another alternative, actuating arm 21 may be replaced by a pair of actuating arms or planar member in which a portion is received and engaged by planar members 19 of plunger 18.

The movement of plunger 16 is caused by electromagnetic forces, which are generated by a current running through coil 14.

One end of a pair of springs 22 are secured to plunger 16 and the other end of springs 22 are secured to a pair of spring position stands 24. Springs 22 are positioned to provide a biasing force in the direction of arrow 26. Accordingly, and in order to position plunger 16 as illustrated by the dashed lines in FIG. 1, the electromagnetic force generated by solenoid 10 must overcome the biasing force of springs 22.

A stator 28 is positioned opposite to plunger 16 and an air gap 30 is defined between plunger 16 and stator 28. In addition, air gap 30 is positioned within coil 14.

Stator 28 is configured to have a first threaded portion 32 and a second threaded portion 34. An engagement surface 36 of spring position stands 24 also has a threaded portion 38. Threaded portion 38 is configured to have the same configuration (i.e. angle, size and slope) of first threaded portion 32.

Second threaded portion 34 of stator 28 is received and engaged in an opening 40 of support structure 12. The inner surfaces of opening 40 are configured to have a threaded engagement surface 42 that is sized and configured to engage second threaded portion 34 of stator 28.

An end portion 44 of stator 28 has an engagement opening 46. (FIG. 2) Engagement opening 46 is configured to receive and engage a tool such as a screwdriver, Allen wrench or other item for applying a rotational force to stator 28.

The pitch or angle of engagement of first pair of threads 32 and 38 is substantially opposite to second pair of threads 34 and 42. In addition, the size of threads 34 and 42 is substantially smaller than threads 32 and 38. In an exemplary embodiment, the size of threads 32 is 10 threads per inch, and the size of threads 34 is 32 threads per inch. Accordingly, there is approximately a 3 to 1 thread ratio between threads 32 and 34. Of course, it is contemplated that the dimensions; size and configuration of threads 32 and 34 may be larger or smaller than the dimensions mentioned above. Accordingly, and as a rotational force is applied to engagement opening 46 in a first direction, stator 28 will move in the direction of arrow 48. This movement of stator 28 will cause the size of air gap 30 to decrease. However, since the angle of engagement of first pair of threads 32 is opposite to that of second pair of threads 34, the movement of stator 28 in the direction of arrow 48, caused by the rotation of stator 28 in a first direction, will also cause spring position stands 24 to move in an opposite direction or in the direction of arrow 50. Moreover, and since the size of threads 32 is substantially larger than the size of threads 34, this movement is at a much greater rate with respect to each revolution of stator 28.

Accordingly, and as spring position stands 24 move in the direction of arrow 50, biasing force of springs 22 is decreased. A pair of shoulder portions 52 are located on the inner surface of support structure 12. Shoulder portions 52 provide an area into which spring position stands 24 can move as they move in the direction of arrows 50.

Accordingly, and as a rotational force is applied to stator 28 in a first direction, the size of air gap 30 is reduced while the biasing force of springs 22 is also reduced.

Conversely, and as a rotational force is applied to stator 28 in a second direction, the size of air gap 30 will increase, while the biasing force of springs 22 is also increased.

Thus, for a low X-setting on the solenoid, it is desirable to have a high-efficiency solenoid that can generate a high output force per Ampere-turn for any given construction. To accomplish this, it is desirable to have a small air gap with a low reverse bias force.

On the other hand, and for a high X-setting on the same solenoid, it is desirable to lower the efficiency of the solenoid and thereby lower the output force per ampere-turn for the same given construction. To accomplish this, it is desirable to have a large air gap with a large reverse bias force.

Accordingly, the solenoid of the instant application allows such adjustments to be made in a quick and convenient manner. Moreover, the same solenoid can be used for such applications.

In addition, and as contemplated in accordance with the instant application, the size and configuration of threaded portions 32 and 34 are configured to obtain a desired result. For example, each revolution of stator 28, or portion thereof, will cause stator 28 to move in a first direction of a known magnitude, while spring position stands 24 move in an opposite direction of a known magnitude. Therefore, and as a rotational force is applied to stator 28, the movement of stator 28 and spring position stands 24 will adjust the trip setting of solenoid 10 to a known value.

Figure 3:
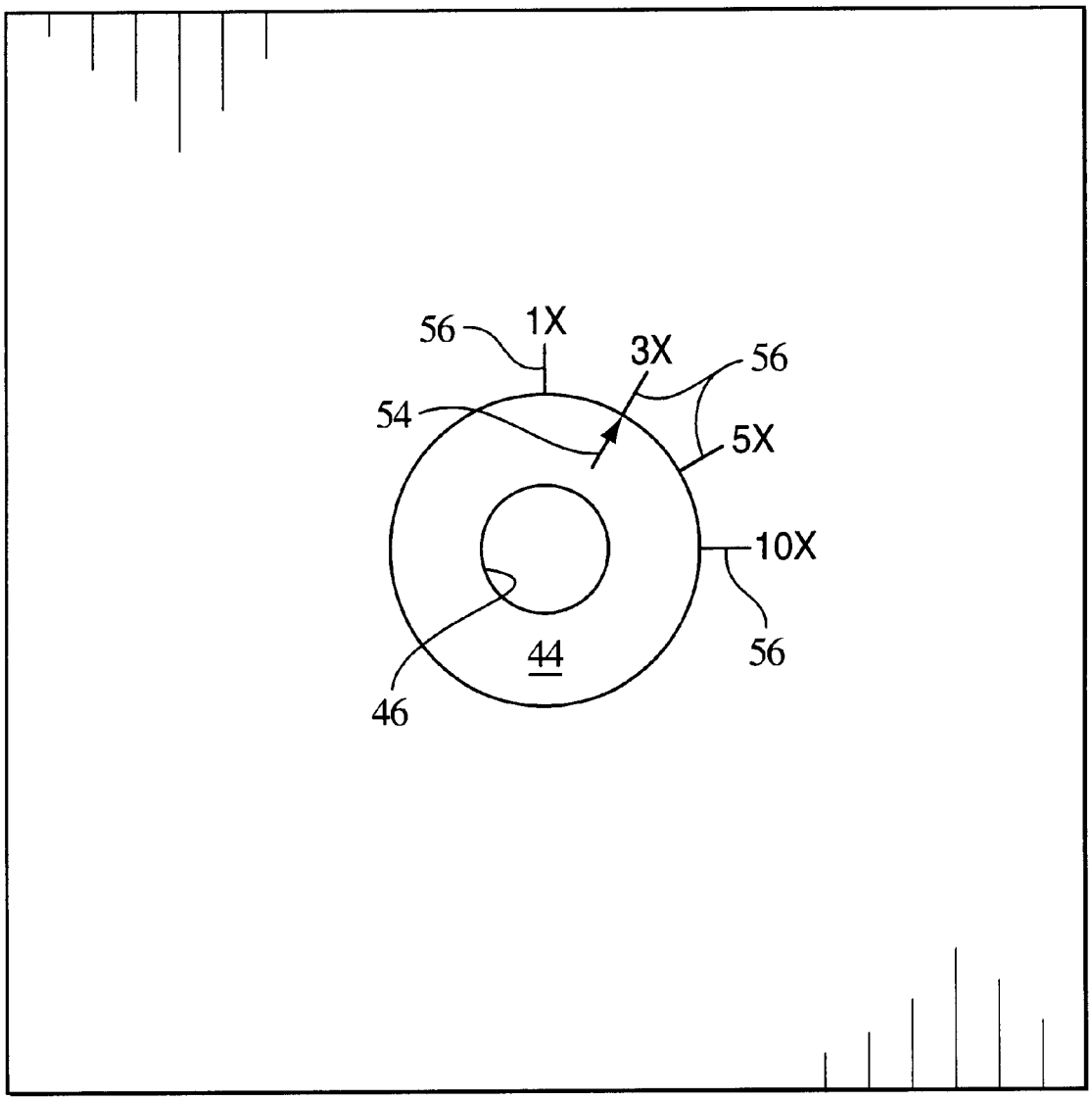
FIG. 3 is a view along lines 3—3 of FIG. 1.

Referring now to FIG. 3, and as an alternative, surface 44 of stator 28 is marked with an indication arrow 54 while the surrounding surface of support structure 12 is also marked with a plurality of markings 56 which will indicate the trip setting of solenoid 10 when arrow 54 is pointing thereto. Of course, alternative marking arrangements are contemplated, such as, demarcations on the inner surface of opening 40 and stator 28 which will indicate the trip setting of solenoid 10 as stator 28 moves within opening 40. For example, such indications may be a color oriented scheme that provides a user with a quick and convenient means of determining the solenoid's trip setting.

Figure 4:
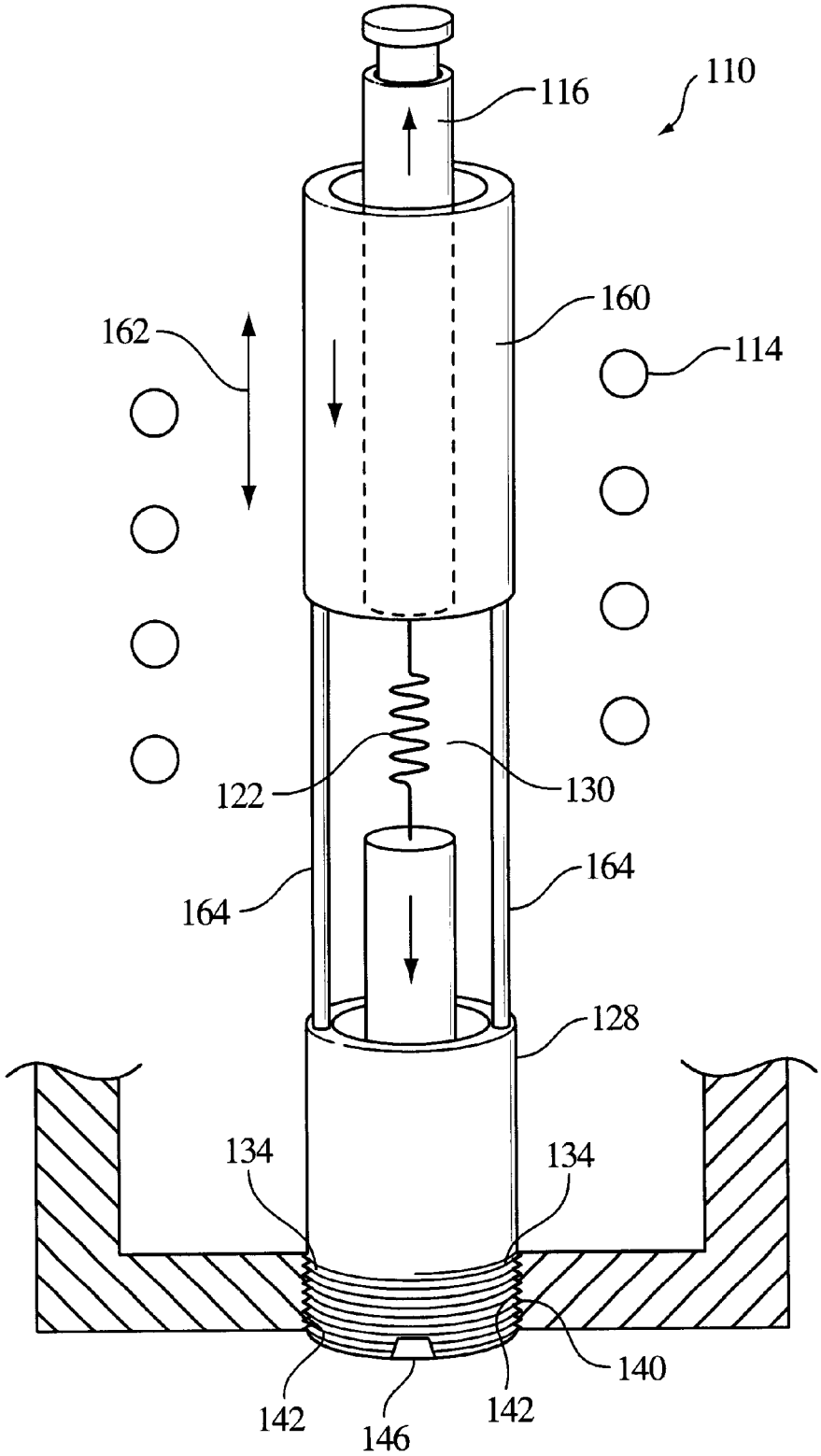
FIG. 4 is a front perspective view of a portion of an alternative embodiment.

Referring now to FIG. 4, an alternative embodiment of the instant application is illustrated. Here, component parts performing similar or analogous functions are numbered in multiples of 100.

Here, a solenoid 110 is configured to have a flux shifter 160. Flux shifter 160 is an elongated sleeve portion constructed out of a ferromagnetic material that is configured to be placed over plunger 116 and is capable of movement in the direction indicated by arrows 162.

Flux shifter 160 is secured to stator 128 by a pair of connection rods 164. Accordingly, and as a rotational force is applied to stator 128, through a tool inserted into engagement opening 146, the threaded portion 134 of stator 128 will travel through the threaded portion 142 of opening 140 which, depending on the direction of the rotational force, will cause stator 128 and accordingly flux shifter 160 to move in either direction of arrows 162.

Accordingly, and as stator 128 is moved in a direction away from plunger 116, air gap 130 increases in size and flux shifter 160 is repositioned to cover a portion or all of air gap 130. Since flux shifter 160 is constructed out of a ferromagnetic material, once it is positioned in close proximity to air gap 130, flux shifter 160 creates a path of lesser reluctance for the magnetic flux of solenoid 110 to travel.

Figure 5:
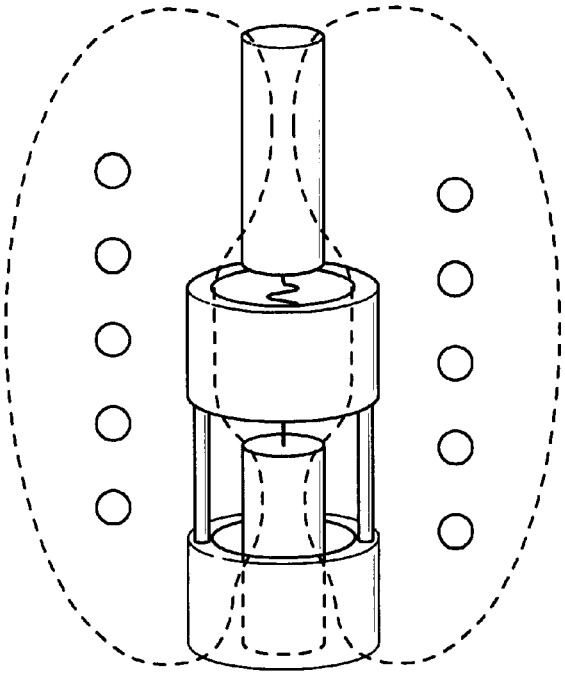
FIG. 5 is a front perspective view of the FIG. 4 embodiment illustrating movement thereof.

For example, and referring now to FIG. 5, as flux shifter 160 covers air gap 130, the flux of solenoid 110 is partially illustrated by the dashed lines in FIG. 4. This positioning of flux shifter 160 will allow solenoid 110 to be able to accept a higher current value through coil 114 before plunger 116 is actuated. Moreover, the size of air gap 130 is also increased in the position illustrated by FIG. 5 this also increases in the amount of flux required to actuate plunger 116.

Figure 6:
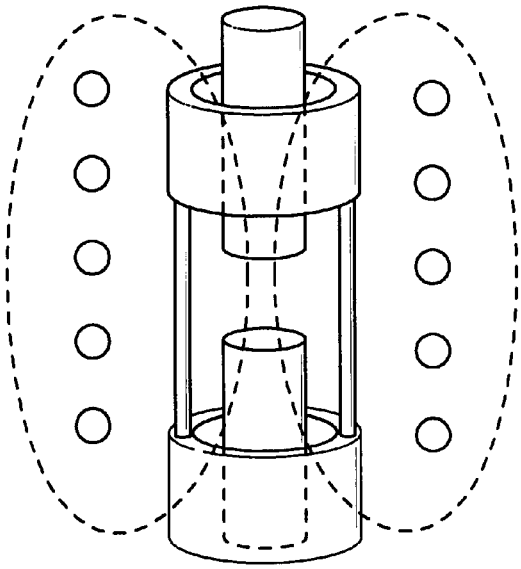
FIG. 6 is a front perspective view of the FIG. 4 embodiment illustrating movement thereof.

Conversely, and as flux shifter 160 and stator 128 are moved back into the position illustrated by FIG. 4, the flux of solenoid 110 is illustrated partially by the dashed lines in FIG. 6.

Comparing solenoid 110 of FIGS. 5 and 6 shows a high-efficiency electromagnetic system in FIG. 6 and a low efficiency electromagnetic system in FIG. 5. Since higher magnetic forces are generated from a solenoid having high efficiency, the magnetic forces generated by solenoid 110 of FIG. 6 will be greater than those of FIG. 5 at a given solenoid current value. Alternatively, for a given trip force, the solenoid 110 of FIG. 6 will have a trip point (activation threshold) at a lower solenoid current than will the solenoid 110 of FIG. 5.

Therefore, solenoid 110 provides the user with a single means of adjustment for introducing flux shifter 160 while concurrently increasing air gap 130 and vice versa. This configuration provides a wide range of trip settings for solenoid 110.

In an exemplary embodiment, solenoid 110 has a low gradient compression spring or springs 122 that has a de minimus change in bias force as stator 128 moves.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An adjustable solenoid, comprising:

a) an enclosure containing a winding through which a current is passed, said winding defining an area;

b) a plunger being positioned at one end of said area, said plunger having an actuating member positioned to pass through an opening in said enclosure, said plunger being configured for movement between an actuating position and a non-actuating position;

c) a mechanical biasing mechanism for providing a biasing force to said plunger, said mechanical biasing mechanism being secured to said plunger at one end and a support at the other;

d) a stator having a first threaded portion being engaged within a threaded opening of said enclosure, said first threaded portion and said threaded opening of said enclosure causing said stator to travel between a first position and a second position as a rotational force is applied to said stator, said first position being closer to said plunger than said second position, said stator being in a facially spaced relationship with respect to said plunger and having a second threaded portion for engaging a threaded portion of said support, said second threaded portion of said stator causing said support to travel between a first position and a second position, said second position of said support provides said mechanical biasing mechanism with a greater biasing force than said first position.

2. The solenoid as in claim 1, wherein said mechanical biasing mechanism is a spring having one end fixedly secured to said plunger and the other end being fixedly secured to said support.

3. The solenoid as in claim 2, wherein said first and second threaded portions of said stator are positioned on a generally circular portion of said stator and said threaded opening in said enclosure is also generally circular in configuration.

4. The solenoid as in claim 3, wherein said support is an annular collar having an inner surface with a threaded portion for engaging said second threaded portion of said stator.

5. The solenoid as in claim 4, wherein said enclosure is configured to have a receiving area to allow for the movement of said annular collar.

6. The solenoid as in claim 1, wherein said enclosure is configured to have a receiving area to allow for the movement of said support.

7. The stator as in claim 3, wherein said stator has an engagement surface with an engagement opening positioned to be engaged from outside of said enclosure.

8. The stator as in claim 7, wherein said engagement surface is marked with indicia and said enclosure is also marked with indicia in close proximity to said indicia of said engagement surface, said indicia of said engagement surface and said indicia of said enclosure indicating the trip setting of said solenoid.

9. The stator as in claim 1, wherein said second threaded portion has a pitch opposite to said first threaded portion.

10. The stator as in claim 9, wherein the thread size of said second threaded portion is substantially larger than said first threaded portion.

11. The stator as in claim 10, wherein said mechanical biasing mechanism is a pair of springs, each of said springs having one end secured to said plunger and the other secured to said support.

12. The stator as in claim 3, wherein said support is a pair of supports and said mechanical biasing mechanism is a pair of springs, each having one end secured to said plunger and the other end secured to one of said supports.

13. The stator as in claim 12, wherein said enclosure is configured to have a receiving area to allow for the movement of said supports.

14. A method for varying the trip setting in a solenoid, comprising:

simultaneously adjusting the size of an air gap between a stator and a plunger of said solenoid and the biasing force of a spring providing a biasing force to said plunger, said biasing force decreases as said air gap decreases.

15. A method for varying the trip setting in a solenoid, comprising:

adjusting the size of an air gap between a stator and a plunger of said solenoid and the biasing force of a spring providing a biasing force to said plunger, said biasing force decreases as said air gap decreases, wherein said stator is movably mounted within said solenoid and said air gap and said biasing force are adjusted by a rotational force applied to said stator.

16. A method for varying the trip setting in a solenoid, comprising:

a) adjusting the size of an air gap between a stator and a plunger of said solenoid by applying a rotational force to said stator; and b) adjusting the biasing force of a spring providing a biasing force to said plunger, said biasing force increases as said rotational force is applied to said stator and said air gap increases.

17. The method as in claim 16, wherein said air gap increases at lesser rate than said biasing force.

18. The method as in claim 16, wherein said stator is movably mounted within said solenoid.

19. The method as in claim 14, wherein said stator is movably mounted within said solenoid.

20. The method as in claim 14, wherein said spring is secured to said plunger at one end and a support member at the other and said stator moves in a opposite direction with respect to said support member as said biasing force decreases and said air gap decreases.

21. An adjustable solenoid, comprising:

a) a plunger being positioned at one end of said solenoid, said plunger being configured for movement between an actuating position and a non-actuating position in response to a magnetic field generated by said solenoid;

b) a biasing member for providing a biasing force to said plunger, said biasing member being secured to said plunger at one end and a support at the other;

d) a stator being movably received within said solenoid, said stator being adapted to move between a first position and a second position, said first position being closer to said plunger than said second position, said stator being in a facially spaced relationship with respect to said plunger and having a means for moveably engaging said support, the movement of said stator towards said first position causes said support to travel from a first position to a second position, said second position of said support provides said biasing member with a lesser biasing force than said first position of said support.

22. The adjustable solenoid as in claim 21, wherein said support moves in an opposite direction with respect to said stator.

23. The adjustable solenoid as in claim 21, wherein said support is an annular ring configured for engaging a threaded portion of said stator.

24. The adjustable solenoid as in claim 23, wherein said adjustable solenoid is configured to have a receiving area for accommodating a range of movement for said annular ring.

25. The adjustable solenoid as in claim 23, wherein said biasing member is a pair of springs each having one end secured to said plunger and the other secured to said annular ring.

26. An adjustable solenoid, comprising:

a) a plunger being positioned at one end of said solenoid, said plunger being configured for movement between an actuating position and a non-actuating position in response to a magnetic field generated by said solenoid;

b) a biasing member for providing a biasing force to said plunger, said biasing member being secured to said plunger at one end and a support at the other; and c) a means for decreasing an air gap between a stator and said plunger while decreasing said biasing force.

27. The adjustable solenoid as in claim 26, wherein said biasing force decreases at a factor of three times that of the decreasing of said air gap.

28. An adjustable solenoid, comprising:

a) a plunger being positioned at one end of said solenoid, said plunger being configured for movement between an actuating position and a non-actuating position in response to a magnetic field generated by said solenoid;

b) a biasing member for providing a biasing force to said plunger, said biasing member being secured to said plunger at one end and a support at the other, the amount of said biasing force being dependant upon the size of the distance between said support and said plunger; and c) a means for varying the distance between a stator of said solenoid and said plunger while simultaneously varying in an opposite manner the distance between said support and said plunger.

29. An adjustable solenoid, comprising:

a) a plunger being positioned at one end of said solenoid, said plunger being configured for movement between an actuating position and a non-actuating position in response to a magnetic field generated by said solenoid;

b) a biasing member for providing a biasing force to said plunger; and c) a means for varying the size of an air gap between a stator and said plunger while simultaneously varying in an opposite manner the size of said biasing force.

* * * * *